US006665987B2

(12) United States Patent
Eve et al.

(10) Patent No.: US 6,665,987 B2
(45) **Date of Patent: *Dec. 23, 2003**

(54) STAIRCASE, STAIRCASE REPAIR DEVICE AND METHODS OF FABRICATING SAME

(75) Inventors: John S. Eve, Highlands Ranch, CO (US); Larry L. Birch, Highlands Ranch, CO (US)

(73) Assignee: Tread Ex, Inc., Littleton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/993,185

(22) Filed: Nov. 13, 2001

(65) Prior Publication Data

US 2002/0029532 A1 Mar. 14, 2002

Related U.S. Application Data

(63) Continuation-in-part of application No. 09/311,526, filed on May 13, 1999, now Pat. No. 6,318,033.

(51) Int. Cl.[7] ..... E04F 11/104

(52) U.S. Cl. ..... 52/182; 52/183; 52/188; 52/177; 52/190; 52/191; 156/64

(58) Field of Search ..... 52/182, 183, 188, 52/190, 191, 177; 156/64

(56) References Cited

U.S. PATENT DOCUMENTS

| | | | | | |
|---|---|---|---|---|---|
| 1,458,708 | A | * | 6/1923 | Jeppson | 52/181 |
| 1,536,895 | A | * | 5/1925 | Lindyberg | 52/514 |
| 2,193,146 | A | * | 3/1940 | Skeel et al. | 52/191 |
| 4,029,852 | A | * | 6/1977 | Palena | 428/621 |
| 4,783,939 | A | * | 11/1988 | Bergmann et al. | 52/188 |
| 4,874,549 | A | * | 10/1989 | Michalchik | 252/511 |
| 4,985,095 | A | * | 1/1991 | Riddle | 156/64 |
| 5,357,724 | A | * | 10/1994 | Sonoda | 52/182 |
| 5,475,951 | A | * | 12/1995 | Litzow | 52/177 |
| 5,660,009 | A | * | 8/1997 | Cousin | 52/183 |
| 5,763,070 | A | * | 6/1998 | Kerlek et al. | 428/329 |
| 5,799,448 | A | * | 9/1998 | Dunk | 52/188 |
| 6,318,033 | B1 | * | 11/2001 | Birch et al. | 52/182 |
| 6,438,909 | B2 | * | 8/2002 | Birch et al. | 52/182 |

* cited by examiner

*Primary Examiner*—Carl D. Friedman
*Assistant Examiner*—Christy M. Green
(74) *Attorney, Agent, or Firm*—Sheridan Ross P.C.

(57) ABSTRACT

In the first embodiment, a staircase repair device or kit is provided which includes two components, namely, a stair tread repair member and a riser repair member. These members are placed on an existing staircase to provide a protective covering. In the second embodiment, a new staircase construction is provided which includes a plurality of stair tread members spanning between standard stringers. The components of the first embodiment and the stair tread member of the second embodiment are made of metal bent to desired shapes. Each is coated with a synthetic material to coat exposed surfaces or to completely encapsulate them therein. A slip-free wearing surface is formed by a layer of particles placed over the first coating, and a second coating of synthetic material which is applied over the dispersed layer of particles. The methods of fabrication include providing the sheets of metal, bending the sheets to a desired shape, spraying the sheets with a first coating, sprinkling a layer of particles on the upper wearing surfaces of the sheets, and then spraying a second coating over the particles to encapsulate them between the first and second coatings.

9 Claims, 2 Drawing Sheets

STAIRCASE, STAIRCASE REPAIR DEVICE AND METHODS OF FABRICATING SAME

CROSS REFERENCE TO RELATED APPLICATION

This application is a continuation-in-part of U.S. patent application Ser. No. 09/311,526, filed May 13, 1999, is now U.S. Pat. No. 6,318,033 which is incorporated herein by reference in its entirety.

TECHNICAL FIELD

The present invention relates to a staircase and a staircase repair device adapted to be used for both residential and commercial buildings and, more particularly, to a staircase including specially constructed stair tread members for use with standard stringers, and a staircase repair device or kit which can refurbish an existing staircase in need of repair without modification of the original staircase. Methods are also provided for fabrication.

BACKGROUND ART

A number of prior art devices exist which relate to the construction of a staircase, or the repair or refurbishing of a staircase. Particularly for conventional outside stairs and emergency stairs in both residential and commercial applications, such stairs are often constructed of materials which do not withstand heavy traffic or harsh environmental conditions. Because of safety concerns, stairs should always be kept in a high state of maintenance. However, the cost to repair damaged staircases can be quite prohibitive, even for minor flaws. For example, stairs formed of concrete which have chips or other surface defects are not only dangerous, but are also unsightly. Concrete repair is usually a very temporary measure and, particularly in high traffic areas, the concrete repair is never as wear-resistant as the original concrete. For wooden stairs, the wood has a tendency to warp or deform along heavy traffic areas. Even if constructed of treated lumber, the wood becomes unsightly over time.

There are a number of examples of prior art devices which have attempted to overcome one or more of the following problems. These devices can be in the form of either a repair unit, or a complete staircase construction.

U.S. Pat. No. 5,357,724 discloses a stair tread in which rubber sheet material is placed around a metal core section, and then heated to melt the sheets together. Once heated, the core section is encapsulated within the rubber. The stair tread has anti-slip serrations formed on its upper surface. A front face or overhanging front lip forms the front edge of the stair tread, and a vertically extending rear flange forms the rear face or edge of the stair tread. The upper edge of the rear face has a groove to accept the lower edge of a riser board, while the upper edge of the riser board is inserted into a corresponding groove formed in the lower edge of the front face of the next higher stair tread.

U.S. Pat. No. 5,799,448 discloses an adjustable closed riser metal staircase system. The system includes a plurality of stair treads which may be assembled into staircases having different rise heights. The stair treads include a vertical riser portion and a horizontal walking surface, preferably made of a slip-resistant material such as Mebac™, a coating of thermally sprayed steel encapsulating a dispersion of grit materials, normally aluminum oxide. The nose piece portion of the stair tread is formed at the front of the stair by bending the forward edge of the steel plate downward. When assembled, the upper end of the riser portion is inserted within a channel created by the bent nosepiece of the next higher stair tread assembly.

U.S. Pat. No. 4,783,939 discloses a composite covering for improving worn out treadways of steps. This covering includes a stair tread section which is placed over the existing stair tread, and an integral vertical flange which overhangs the front lip of the stair tread section. The covering is constructed of a scuff-resistant plastic. The underside of the stair tread section includes an insert of pressboard, and a binder which helps raise the elevation of worn out sections or indentations, and also serves to bind the layers of the composite covering.

U.S. Pat. No. 5,660,009 discloses a metal stairway construction in which stair steps are supported between a pair of trimmed sheet metal stringer panels on each side of the stairway. Each step of the stairway is formed of metal treads and risers cut to appropriate lengths from conventional joice members provided on site. The metal treads and risers are attached at opposite ends thereof to respective stringer panels by way of standard angle brackets. Threaded self-drilling fasteners attach each angle bracket to a corresponding stringer panel and to an associated metal tread or metal riser. Wooden treads and risers are attached over the corresponding metal treads and risers by standard self-drilling screws.

While the foregoing references may be adequate for their intended purposes, there are certain advantages with the present invention which are not found in these references. One advantage is that the staircase repair device of this invention can be used with any type of existing staircase, whether it be concrete, wood, or metal. Another advantage is that this staircase repair device can be used to repair a staircase without preparation or modification of the original staircase wear surfaces. Yet another advantage not overcome by the prior art is the use of a staircase repair device which has high strength and weathering capabilities, yet does not detract from the general aesthetic appearance of the staircase. The same advantages discussed above also apply to the staircase of this invention. Additionally, the staircase of this invention is simple in design, and can be used for stairways in a wide array of residential and commercial buildings.

DISCLOSURE OF THE INVENTION

In accordance with this invention, a staircase and a staircase repair device or kit are provided. The staircase repair device or kit forms a first embodiment and is comprised of two major components, namely, a stair tread repair member and a riser repair member. Both of these members are constructed of metal, preferably raw steel, bent to desired shapes. The stair tread repair member includes a front flange and an inward protruding lip. Holes may be drilled in the wearing surface of the stair tread repair member in order to accept fasteners which help to secure the stair tread repair member to an existing stair tread. The riser repair member includes an outward protruding flange. Holes may also be drilled in the riser repair member to accept fasteners for attachment of the riser repair member to an existing staircase riser. Both the stair tread and riser repair members are coated with a synthetic material which protects the metal from corrosion and other environmental hazards. The coating is preferably in the form of a polyurea or polyurethane which is sprayed in liquid form to encapsulate the members therein. The upper wearing surface of the stair tread repair member also has a slip-free surface. This slip-free surface is formed by particles which are spread or sprinkled over the first sprayed coating of synthetic material. These particles are spread on the first coating while it is wet which allows the particles to become embedded in the first coating. Then, a second coating of synthetic material is sprayed over the embedded particles to seal the particles between the first and second coatings. The particles may be materials such as coal dust, aluminum oxide, walnut shells, and other known granular-type material which is used to create slip-free surfaces. It shall be understood that the stair tread repair member serves as a subcombination which may be used to repair the stair treads of an existing staircase.

In a second embodiment, the invention is a staircase which includes a plurality of stair tread members which span between a pair of spaced stringers. The stair tread member is similar to the stair tread repair member of the first embodiment in that it is also constructed of metal bent to a desired shape encapsulated within a first coating of synthetic material, and having a slip-free surface made of a particulate material sandwiched between the first coating and a second applied coating. The stair tread member further includes a pair of opposed side flanges disposed on opposite ends of the stair tread member, and opposing front and rear flanges. The stair tread member spans between a pair of common stringers used in construction of staircases. The stair tread member may be mounted to the facing inner surfaces of the stringers, or may be mounted over the outer surfaces of the stringers. Optionally, an L bracket or other similar supporting hardware may be used to secure the stair tread member to the inner surfaces of the stringers.

The second embodiment may be used in conjunction with either metal or wood stringers. Holes are drilled in the side flanges for receiving fasteners which secure the stair tread member to the stringers. If desired, a riser member could also be used with the invention of the second embodiment. More specifically, a riser similar to the riser repair member of the first embodiment could be used in the second embodiment. The riser in the second embodiment could simply be rectangular in shape and coated in the same way as the other components.

Methods of fabricating a stair tread repair member and of fabricating a stair tread member in a new staircase are also provided. Both methods involve the provision of a flat sheet of metal cut to a desired size. The metal sheet is sanded to roughen its surfaces in preparation for coating with a synthetic material. A primer may be applied to further prepare the metal sheet for coating. The metal sheet is bent by a metal brake machine to the desired shape. In fabrication of the stair tread repair member, the sheet is bent to form the front flange and inward protruding lip. For the stair tread member of a new staircase, the sheet is bent to include front and rear flanges, and the opposed side flanges. In order to bend the sheet of metal used in the stair tread member, corner sections are removed. After the sheet has been bent, the joints formed at the corners of the stair tread members may be welded together. Prior to or after bending, screw holes are punched or drilled in the metal sheets enabling fasteners to be received therethrough.

Once the stair tread repair member and the stair tread member have been bent to the desired shapes, they may be sprayed with a synthetic coating, preferably the polyurea or polyurethane. This coating can be applied to all exposed surfaces. The coating of the members helps to ensure that all surfaces are protected from corrosion and other environmental hazards. The upper wearing surfaces of the members are then sprinkled with a dispersed layer of particles. This preferably occurs when the first applied coating is still wet which enables the particles to become embedded within the first coating. A second coating is then applied over the dispersed layer of particles to encapsulate the particles between the first and second coatings. A slip-free surface is therefore formed by the second coating covering the particles. In addition to providing weather-resistant surfaces, the coatings of polyurea or polyurethane also help to dampen noise normally associated with metal stair treads, and help to keep the wearing surfaces scuff-free. Additionally, the applied coating may be mixed with a desired color which enables the components to match or complement existing colors on the building. For the staircase embodiment, the stair tread members may include diagonal stress lines pressed on the upper wearing surfaces. This pre-stressing of the upper wearing surfaces adds strength to resist any buckling or wobbling of the upper wearing surfaces.

The apparatuses and methods of this invention provide a staircase repair device and a staircase which are extremely durable, simple in construction, aesthetically pleasing, have integral slip-free surfaces, and resist scuffing. Furthermore, these devices are simple to install and are universal in their ability to be used for all types of buildings.

Additional advantages of this invention will become apparent from the description which follows, taken in conjunction with the accompanying drawings.

BEST MODE FOR CARRYING OUT THE INVENTION

Figure 1:
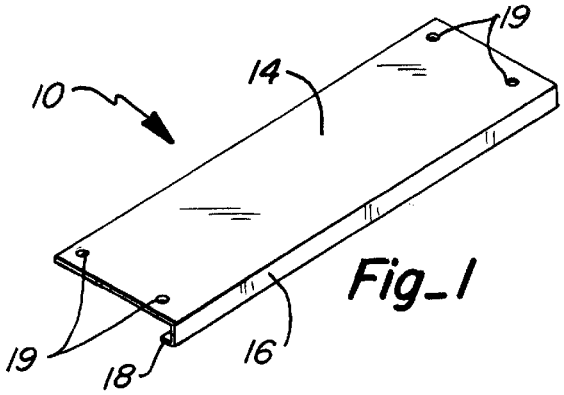
FIG. 1 is a perspective view of a stair tread repair member of the first embodiment.
Figure 2:
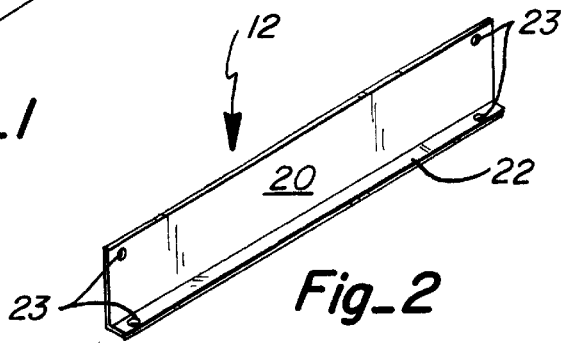
FIG. 2 is a perspective view of a riser repair member of the first embodiment.

According to a first embodiment, a stair case repair device is shown in FIGS. 1 and 2 which comprises a stair tread repair member 10 and a riser repair member 12. The stair tread repair member 10 has a wearing surface 14, and a front flange 16 extending from the forward or front edge of the wearing surface 14. Contiguous with the front flange 16 is an inward protruding lip 18. A plurality of holes 19 may be drilled through the wearing surface 14 to receive fasteners. The riser repair member in FIG. 2 has a riser surface 20 and an outwardly protruding flange 22. A plurality of holes 23 may be drilled in both riser surface 20 and flange 22 to receive fasteners.

Figure 3:
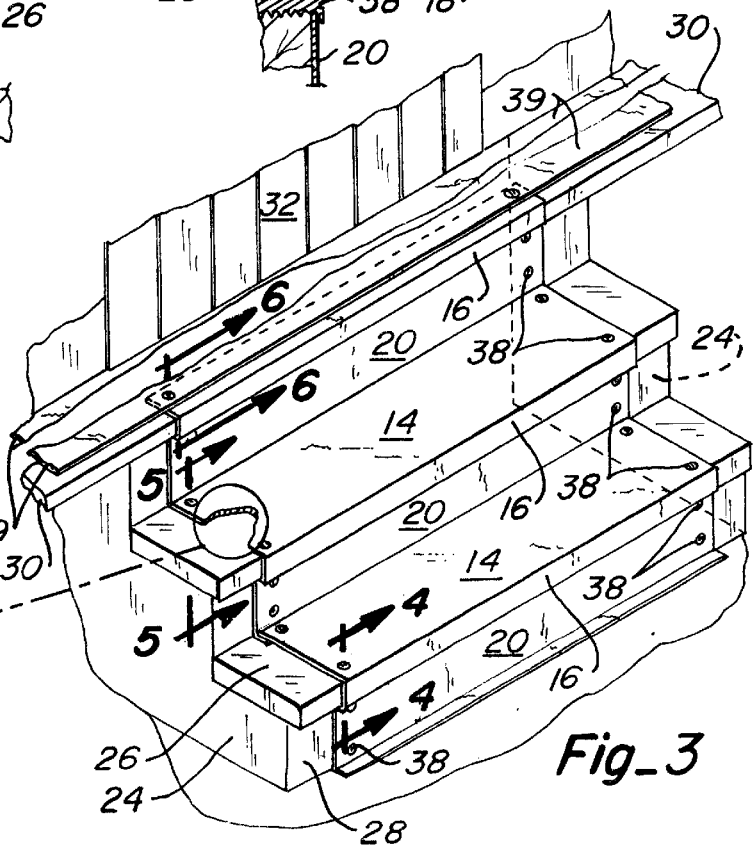
FIG. 3 is a fragmentary perspective view of the staircase repair device of the first embodiment mounted to an existing staircase or stairway.

FIG. 3 illustrates the staircase repair device installed on an existing stairway or staircase. As shown, the existing stairway has a plurality of stair treads 26 which are mounted between a pair of stringers 24. A plurality of vertical risers 28 are also mounted between the stringers 24. The top of the stairway leads to a landing 30 which communicates with a doorway 32.

Figure 4:
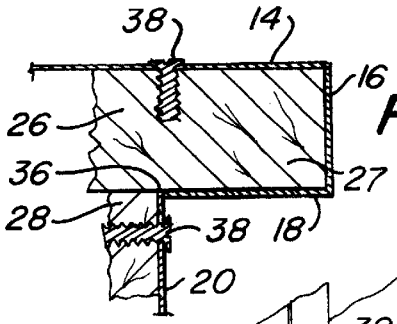
FIG. 4 is an enlarged vertical section, taken along line 4—4 of FIG. 3 illustrating one manner in which the first embodiment may be mounted to the existing staircase.

FIG. 4 illustrates in further detail the manner in which stair tread repair members 10 and riser repair members 12 are secured to the staircase. As shown, fasteners 38 may be placed through holes 19 and 23, respectively. Additionally, an appropriate industrial adhesive or cement (not shown) may be used to secure members 10 and 12 to respective stair treads 26 and risers 28. FIG. 4 illustrates wearing surface 14, front flange 16, and lip 18 closely conforming to the lip 27 of the stair tread 26. However, it will understood that front flange 16 and lip 18 function equally as well even if there is some gap which exists between these members and the exterior surfaces of lip 27. Also, the size and shape of front flange 16 and lip 18 may be modified to fit the particular type of staircase encountered. As further shown in FIG. 4, the upper edge of riser surface 20 extends very nearly to or in contact with the edge of lip 18. It should also be understood that riser repair member 12 functions equally as well even if there is some gap between lip 18 and riser surface 20.

Figure 5:
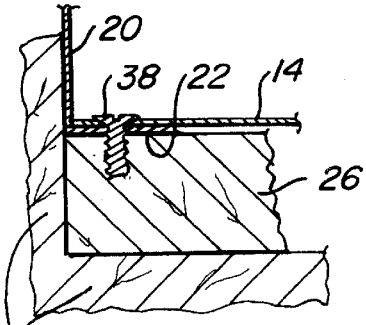
FIG. 5 is an enlarged vertical section taken along line 5—5 of FIG. 3 illustrating further details on the mounting of the first embodiment to the existing staircase.

As shown in FIG. 5, the edge of flange 22 is placed underneath the rear edge of wearing surface 14. Fasteners 38 may also be used to secure the members to each other and to stair tread 26 at this location.

Figure 6:
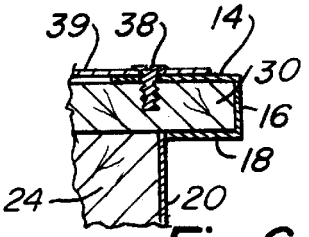
FIG. 6 is an enlarged vertical section taken along line 6—6 of FIG. 3 illustrating yet further details on the mounting of the first embodiment to the existing staircase.

As shown in FIG. 6, the landing 30 may be repaired by the use of landing repair member 39. Landing repair member 39 may also be used to provide continuity with the covered stairway even if the landing is not damaged. The landing repair member 39 may be secured to the landing 30 by means of adhesive/cement, and/or by a plurality of fasteners 38 extending through landing member 30 and the edge of wearing surface 14.

Figure 7:
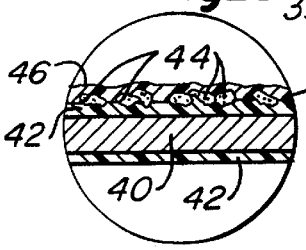
FIG. 7 is an enlarged fragmentary cross section of the stair tread repair member in FIG. 3 which illustrates a core metal layer, a first applied coating of synthetic material encapsulating the core metal layer, a dispersed layer of particles applied on the upper wearing surface, and a second coating placed on the dispersed layer of particles and trapping them between the first and second coatings.

FIG. 7 more specifically shows a cross section of materials used to construct the stair tread repair member 10. A steel layer 40 is encapsulated within a first layer or coating of synthetic material 42. Preferably, this coating is polyurea or polyurethane which is sprayed directly onto the steel layer 40. As shown, this layer covers both the upper surface and the lower surface. A dispersed layer of particles 44 is then sprinkled over the first layer 42. If the first layer 42 is wet when the layer of particles 44 is applied, the particles 44 will be embedded within the first layer 42 as shown. However, it will be understood that the dispersed layer of particles 44 may be applied after the first layer 42 has been allowed to dry. A second layer of coating is applied over the dispersed layer of particles 44 trapping or encapsulating them between the first and second layers. Thus, the upper surface of the stair tread repair member 10 has an undulating or rough surface which is slip-free. The coating used is extremely wear-resistant and serves not only to protect the steel core, but also to provide a bonding and scaling agent for the dispersed layer of particles 44. The riser repair member 12 is also coated with a layer of polyurea or polyurethane; however, no slip-free surface is required so no layer of particles or second layer of coating is applied. Landing repair member 39 may be made of the same composite construction as stair tread repair member 10.

Although the first embodiment illustrates the use of both stair tread repair members and riser repair members, it shall be understood that the stair tread repair members alone can be used to repair damaged staircases when such staircases have or do not have risers. Since risers are not wearing surfaces, a more cost-effective repair can be completed without the use of the riser repair members. Thus, the stair tread repair members serve as a valuable subcombination of the first embodiment.

Figure 8:
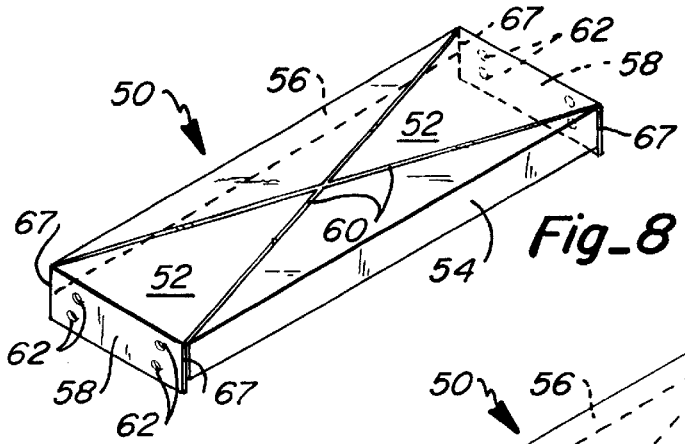
FIG. 8 is a perspective view of a stair tread member of the second embodiment.
Figure 10:
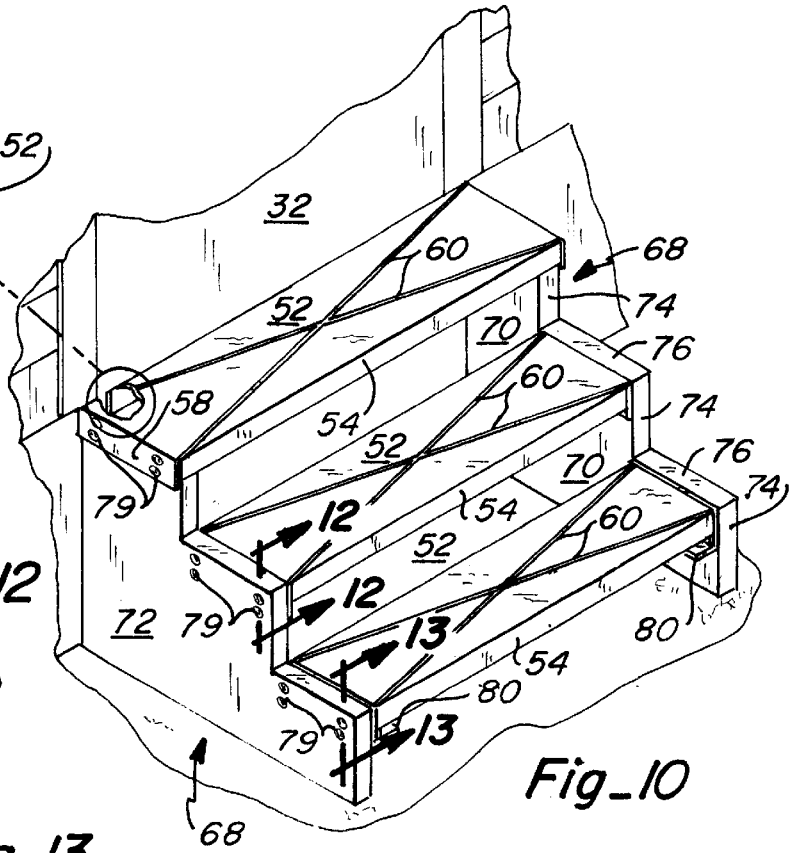
FIG. 10 is a fragmentary perspective view of the staircase construction of the second embodiment illustrating stair tread repair members being mounted to stringers in three different manners.

FIG. 10 illustrates the second embodiment of this invention which is a stairway or staircase. This staircase includes two primary members, namely, a plurality of stair tread members 50, and a pair of opposed stringers 68. Beginning first with a discussion of the stair tread members 50, one of which is shown in FIG. 8, each includes a wearing surface 52, a front flange 54, a rear flange 56, and a pair of opposed side flanges 58. A pair of diagonally opposed stress lines 60 may be formed on the wearing surface 52 to add bending strength. A plurality of holes 62 may be drilled in side flanges 58 in order to receive fasteners, as further discussed below.

Figure 9:
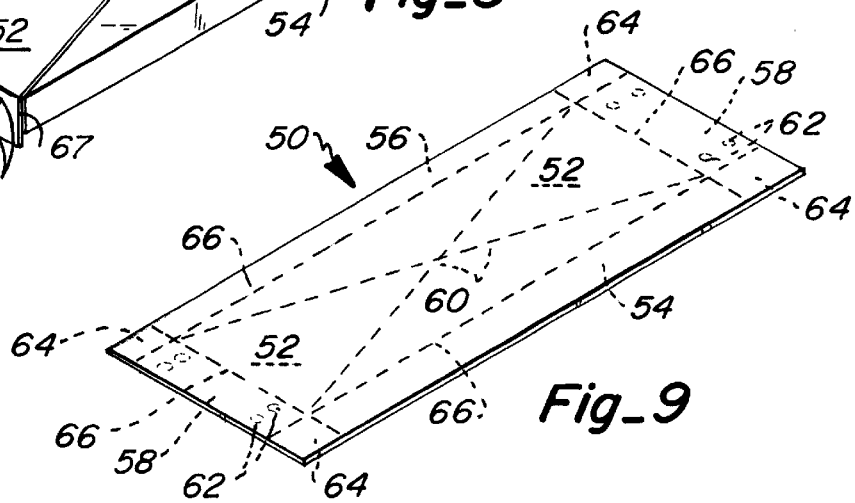
FIG. 9 is a perspective view of the stair tread member of FIG. 8 prior to being bent into the desired shape.

FIG. 9 illustrates a stair tread member 50 prior to being bent into shape. Comer sections 64 are removed which enable the sheet of material to be bent along bend lines 66. Bending may be achieved by a standard metal break machine. Preferably, holes 62 are drilled prior to bending the member 50 into shape. Stress lines 60 are also formed during the metal break operation. Thus, it is clear that stair tread members 50 may be formed simply from rectangular sheets of metal. After bending, corners 67 may secured as by welding, or other well known means.

Figure 11:
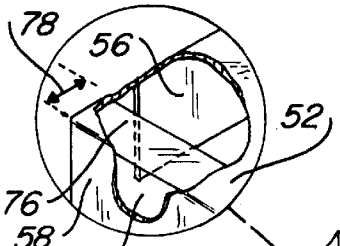
FIG. 11 is an enlarged fragmentary perspective view of FIG. 10 illustrating details of how a stair tread member is mounted over the stringer.

FIG. 10 illustrates the staircase assembled, and further shows three ways in which stair tread members 50 may be mounted to the pair of stringers 68. Stringers 68 may be of any well-known construction to include cut pieces of lumber, or cut pieces of heavy gauge metal. The stringers 68 each have inner surfaces 70, outer surfaces 72, and upper surfaces defined by a plurality of continuous rises 74 and runs 76. The details of how the most upper stair tread member 50 attaches to the stringers 68 is shown in FIG. 11. In this case, the stair tread member 50 is mounted over the outside surfaces 72 of stringers 68. Side flanges 58 are placed over outer surfaces 72. In order to allow the stair tread member 50 to fit over runs 76, slots are cut out of the rear flange 56 near the rear corners at least a width as wide as the width of run 76. In FIG. 11, the width of the slot removed is shown as width 78. As needed, fasteners 79 are then used to secure the stair tread member 50.

Figure 12:
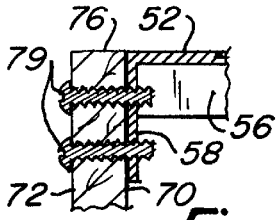
FIG. 12 is an enlarged fragmentary vertical section taken along line 12—12 of FIG. 10 illustrating details of how a stair tread member may be mounted to the inner surfaces of the stringers.

An alternate manner in which to mount a stair tread member 50 to the stringers 68 is through an inside mount. This is shown in FIG. 12 wherein side flanges 58 are secured to the inner surfaces 70 of stringers 68. Fasteners 79 may also be used to secure the connection. Thus, the method shown in FIG. 12 requires the stair tread member 50 to be slightly shorter in length to accommodate the smaller gap between the inner surfaces 70 of the opposed stringers 68.

Figure 13:
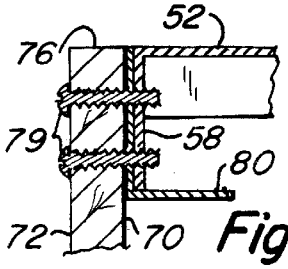
FIG. 13 is another enlarged fragmentary vertical section taken along line 13—13 of FIG. 10 illustrating another manner in which a stair tread member may be mounted to the inner surfaces of the stringers.

FIG. 13 shows yet another manner in which the stair tread members 50 may be secured to the stringers 68. As shown, this is also an inside mount, but further includes the use of L-shaped brackets 80 which help to stabilize the connection. As shown, L brackets 80 are placed between side flanges 58 and inner surfaces 70. Fasteners 79 may also be used to secure the connection.

Although FIG. 10 does not illustrate the use of risers, it shall be understood that risers can also be used. Riser repair member 12 of the first embodiment may be modified to simply eliminate flange 22, resulting in a rectangular shaped member. This rectangular shaped member may be sized to fit the particular rise 74, and then secured thereto, either by fastener 79 or adhesive. Stair tread members 50 are made of the same composite construction shown in FIG. 7. If risers are used in this second embodiment, then they can be coated in the same manner as the riser repair members 12 of the first embodiment.

Both the first and second embodiments illustrate staircases with risers that include continuous rises and runs. However, it shall be clearly understood that both the first and second embodiments can be used with any type of stringers to include those which do not have continuous rises and runs, but have continuous flat upper surfaces. For these types of stringers, the stair tread members of the second embodiment must utilize an inside mount.

In practice, it has been found that stair tread repair members 10 and stair tread members 50 can be made of 18 gauge metal which provide adequate strength to resist undue deformation or bending. It has also been found that riser repair members 12 may be made of a thinner gauge steel, such as 24 gauge. In heavy traffic areas, it has also been found that 16 gauge metal is acceptable for stair tread members 50. Examples of commercially available polyurethane spray coatings which may be used with this invention include Bullhide™ manufactured by Bullhide, Inc.

It should also be understood that the dispersed layer of particles could be applied as a mixture with the coating spray. That is, particularly for smaller sized particles, a combination of the polyurea or polyurethane and the particles could be sprayed simultaneously as a composite coating. The polyurea/polyurethane and particles can be premixed in a hopper, and then can be sprayed from a standard commercial spray gun. Furthermore, it should be understood that a single layer of coating can be utilized without a second covering or coating. Depending upon the thickness of the first coating, it may only be necessary to apply a single coating wherein the dispersed layer of particles are adequately held within the single coating.

Although a dispersed layer of particles is advantageous for use in providing a slip-free surface, the coating of synthetic material itself may provide enough friction as compared to the existing staircase; therefore, the dispersed layer of particles does not have to be applied.

The specific amount of coatings applied to the components may vary as desired. In practice, it has been found that the lower surfaces of the components are adequately covered with a 60 mil covering, and the upper surfaces are adequately covered with an 80 mil coating. For the second coating applied over the dispersed layer of particles, 40 mils has been found to be adequate. The polyurethane spray will adequately dry and cure by air drying. No heat treatment is required; however, drying time can be shortened by use of heat lamps or other heating means.

For the first embodiment, there is no requirement that the wearing surfaces of the existing staircase be repaired or otherwise prepared. For example, damage to the stair treads in the form of holes or other imperfections do not have to be filled prior to installing the invention. Because the invention includes continuous sheets of high strength material, they are able to cover imperfections in the underlying surfaces yet provide the desired walking or wear surfaces. Of course, if the existing staircase is structurally unstable, it must be repaired prior to installing the invention.

One clear advantage of the invention is the simplicity of its construction. The components making up each of the embodiments are simply bent sheets of metal encapsulated within a synthetic coating. An integral slip-free tread surface is formed directly on the first coating. The invention may also be adapted for use with literally any type of staircase or stairway requirement. Each of the components may be sized and bent to specifications without altering the general principles of the invention.

Furthermore, the invention can be constructed with relatively simple machinery and processes. A standard metal break machine may be used to bend the components to desired shapes. Polyurea or polyurethane as a spray coating is readily available and can be applied with standard industrial sprayers. Since no heat treating is required, the coatings may simply air dry. Any number of differing types of particles may be used to create the slip-free wearing surfaces. Depending upon the application, the particles may be applied in a mixture, or by themselves in a homogenous layer. Yet another advantage of this invention is the ease with which it is installed. Standard fasteners such as screws or bolts are used to assemble the components, along with adhesive or glue, as necessary. No special tools are required for assembly, and the components are easily shipped and stored.

This invention has been described in detail with reference to particular embodiments thereof, but it will be understood that various other modifications can be effected within the spirit and scope of this invention.

What is claimed is:

1. In combination, an existing staircase and a staircase repair device, said combination comprising:

an existing staircase including at least one stair tread;

a staircase repair device, said staircase repair device including:

a stair tread repair member having an upper horizontal wearing surface for covering at lease one stair tread of said existing staircase, and having a lower surface;

a first covering of synthetic material placed on said upper horizontal wearing surface and said lower surface; and a dispersed layer of particles intermixed with said first covering of synthetic material of said upper horizontal wearing surface.

2. The combination, as claimed in claim 1, further including:

a second covering of synthetic material placed on said dispersed layer of particles encapsulating said dispersed layer of particles between said first covering of synthetic material and said second covering of synthetic material.

3. The combination, as claimed in claim 1, wherein:

said stair tread repair member further includes a downwardly projecting front flange contiguous with said upper horizontal wearing surface.

4. The combination, as claimed in claim 3, wherein:

said stair tread repair member further includes an inward projecting lip contiguous with said downward projecting front flange.

5. The combination, as claimed in claim 1, said combination further including:

at least one riser extending from said at least one stair tread; and a riser repair member having a vertical riser surface for covering said at least one riser of said existing staircase adjacent said stair tread repair member.

6. In combination, an existing staircase and a staircase repair device, said combination comprising:

an existing staircase including at least one stair tread having a substantially flat surfaced stair tread;

a staircase repair device, said staircase repair device including:

a stair tread repair member having an upper horizontal wearing surface for covering said at least one stair tread of said existing staircase, and having a lower surface;

a first covering of synthetic material placed on said upper horizontal wearing surface and said lower surface; and a downwardly projecting front flange contiguous with said upper horizontal wearing surface, said downwardly projecting front flange substantially conforming to a front edge of the at least one stair tread.

7. The combination, as claimed in claim 6, further including:

a dispersed layer of particles intermixed with said first covering of synthetic material of said upper horizontal wearing surface; and a second covering of synthetic material placed on said dispersed layer of particles encapsulating said dispersed layer of particles between said first covering of synthetic material and said second covering of synthetic material.

8. In combination, an existing staircase and staircase repair device, said combination comprising:

an existing staircase including at least one stair tread;

a staircase repair device, said staircase repair device including:

a stair tread repair member having an upward horizontal wearing surface for covering said at least one stair tread of said existing staircase, and having a lower surface;

a first covering of synthetic material placed on said upper and lower surfaces of said stair tread repair member;

at least one riser extending from said at least one stair tread; and a riser repair member having a vertical riser surface for covering said at least one riser of said existing staircase adjacent said stair tread repair member, said riser surface being covered by a first riser covering of synthetic material.

9. The combination, as claimed in claim 8, wherein:

said first covering of synthetic material and said dispersed layer of particles are sprayed as a mixture onto said stair tread repair member.

* * * * *

UNITED STATES PATENT AND TRADEMARK OFFICE

CERTIFICATE OF CORRECTION

PATENT NO. : 6,665,987 B2
DATED : December 23, 2003
INVENTOR(S) : John S. Eve

It is certified that error appears in the above-identified patent and that said Letters Patent is hereby corrected as shown below:

Title page,
Item [*] Notice, please delete "0 days" and insert -- 21 days -- therefore.

Signed and Sealed this

First Day of June, 2004

JON W. DUDAS
*Acting Director of the United States Patent and Trademark Office*